US008887848B2

(12) United States Patent
Ishizuka et al.

(10) Patent No.: US 8,887,848 B2
(45) Date of Patent: Nov. 18, 2014

(54) FORKLIFT

(71) Applicant: Sumitomo Heavy Industries, Ltd., Tokyo (JP)

(72) Inventors: Masayuki Ishizuka, Yokosuka (JP); Masato Ikegami, Yokosuka (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/951,624

(22) Filed: Jul. 26, 2013

(65) Prior Publication Data

US 2014/0034423 A1 Feb. 6, 2014

(30) Foreign Application Priority Data

Jul. 31, 2012 (JP) ..... 2012-169890

(51) Int. Cl.
*B60K 11/06* (2006.01)
*B66F 9/075* (2006.01)

(52) U.S. Cl.
CPC ..... *B66F 9/07595* (2013.01); *B66F 9/07572* (2013.01)
USPC ..... 180/68.1; 180/65.1; 180/68.2

(58) Field of Classification Search
CPC ... B66F 9/07572; B66F 9/07595; B60K 7/00; B60K 7/0007; B60K 11/06; B60K 1/02
USPC ..... 180/65.1, 68.1, 68.2, 65.51; 310/58
See application file for complete search history.

(56) References Cited

U.S. PATENT DOCUMENTS 2,615,937 A * 10/1952 Ludwig et al. ..... 310/63
3,437,855 A * 4/1969 Laing ..... 310/62
5,558,174 A * 9/1996 Avitan et al. ..... 180/60
5,638,387 A * 6/1997 Palleggi et al. ..... 318/67
6,011,331 A * 1/2000 Gierer et al. ..... 310/58
6,148,940 A * 11/2000 Hokanson et al. ..... 180/65.51
6,703,730 B2 * 3/2004 Hayashi ..... 310/62
7,000,716 B2 * 2/2006 Leifert ..... 180/65.1
7,784,572 B2 * 8/2010 Bald et al. ..... 180/13
8,136,618 B2 * 3/2012 Field ..... 180/68.1
8,459,387 B2 * 6/2013 Field ..... 180/68.1
2008/0060860 A1 * 3/2008 Murase et al. ..... 180/65.3
2008/0101906 A1 * 5/2008 Gotz et al. ..... 414/544
2008/0120974 A1 * 5/2008 Dong et al. ..... 60/464
2008/0202857 A1 * 8/2008 Waltz et al. ..... 187/233
2011/0147104 A1 * 6/2011 Ogawa ..... 180/65.22

FOREIGN PATENT DOCUMENTS

JP 2001-187700 A 7/2001
JP 2004-122916 A 4/2004
JP 2004-260969 A 9/2004

OTHER PUBLICATIONS

European Search Report application No. 13020060.3 dated Oct. 28, 2013.

* cited by examiner

*Primary Examiner* — Katy M Ebner
(74) *Attorney, Agent, or Firm* — Squire Patton Boggs (US) LLP

(57) ABSTRACT

A forklift includes a wheel driving device that includes a traveling motor and drives a wheel; and a cargo handling device that includes a cargo handling motor and drives a cargo handling mechanism. The cargo handling motor includes a wind generating mechanism that generates wind by the rotation of a motor shaft of the cargo handling motor; and a discharge port that discharges the wind generated by this wind generating mechanism. The cargo handling motor is arranged in a vehicle body of the forklift so that wind discharged from the discharge port reaches the wheel driving device.

6 Claims, 8 Drawing Sheets

FORKLIFT

INCORPORATION BY REFERENCE

Priority is claimed to Japanese Patent Application No. 2012-169890, filed Jul. 31, 2012, the entire content of which is incorporated herein by reference.

BACKGROUND

1. Technical Field

The present invention relates to a forklift.

2. Description of the Related Art

The related art discloses a forklift including a wheel driving device that has a traveling motor and drives a wheel, and a cargo handling device that has a motor for an operating machine (cargo handling motor) and drives a cargo handling mechanism.

The traveling motor is operated with a battery mounted on a vehicle body as a driving source, and drives a wheel (specifically, front wheels) of the forklift.

The cargo handling motor is driven independently from the traveling motor, and drives the cargo handling mechanism for tilting of a mast of the forklift, lowering and lifting of a lift bracket (fork) along the mast, or the like.

The traveling motor of the related art includes a cooling fan on the downstream. An air discharge port in the traveling motor and an air suction port in the cargo handling motor are coupled together with a duct. Thereby, a wind generated by the cooling fan of the traveling motor cools the traveling motor itself and also cools the cargo handling motor.

SUMMARY

According to an embodiment of the present invention, there is provided a forklift including a wheel driving device that includes a traveling motor and drives a wheel; and a cargo handling device that includes a cargo handling motor and drives a cargo handling mechanism. Here, the cargo handling motor includes a wind generating mechanism that generates wind by the rotation of a motor shaft of the cargo handling motor; and a discharge port that discharges the wind generated by the wind generating mechanism, and the cargo handling motor is arranged in a vehicle body of the forklift so that wind discharged from the discharge port reaches the wheel driving device.

DETAILED DESCRIPTION

It is hard to say that the cooling structure of the related art based on this development idea is necessarily a structure in which "the unique structure and operational characteristic of the forklift" are exactly grasped when a drive system and a cooling system of the forklift are seen as a whole. Particularly, it is an actual situation in which sufficient cooling cannot be performed in respective portions of the wheel driving device.

It is desirable to provide a forklift that can adopt a more rational cooling structure to cool a wheel driving device effectively.

Although the differences between the cooling idea of an embodiment of the invention and the cooling idea of the related art will be described below in detail, in the embodiment of the present invention, the direction (flow) of a wind that is generated between the traveling motor and the cargo handling motor is "opposite to" the direction of the related art.

An embodiment of the present invention is configured so that attention is paid to the fact that the cargo handling motor is actively moved during a cargo handling operation in which the wheel driving device becomes severe in terms of overheating, and the wind generated by the rotation of the motor shaft of the cargo handling motor reaches the wheel driving device. Thereby, for example, even during a cargo handling operation in which the traveling speed is slow, which is unique to the forklift, the wheel driving device can be efficiently cooled by the cargo handling motor, and the wheel driving device that tends to become thermally severe can be excellently cooled.

According to an embodiment of the invention, a forklift that can cool the wheel driving device effectively is obtained.

Forklifts related to examples of embodiments of the invention will be described in detail with reference to the drawings.

Figure 1:
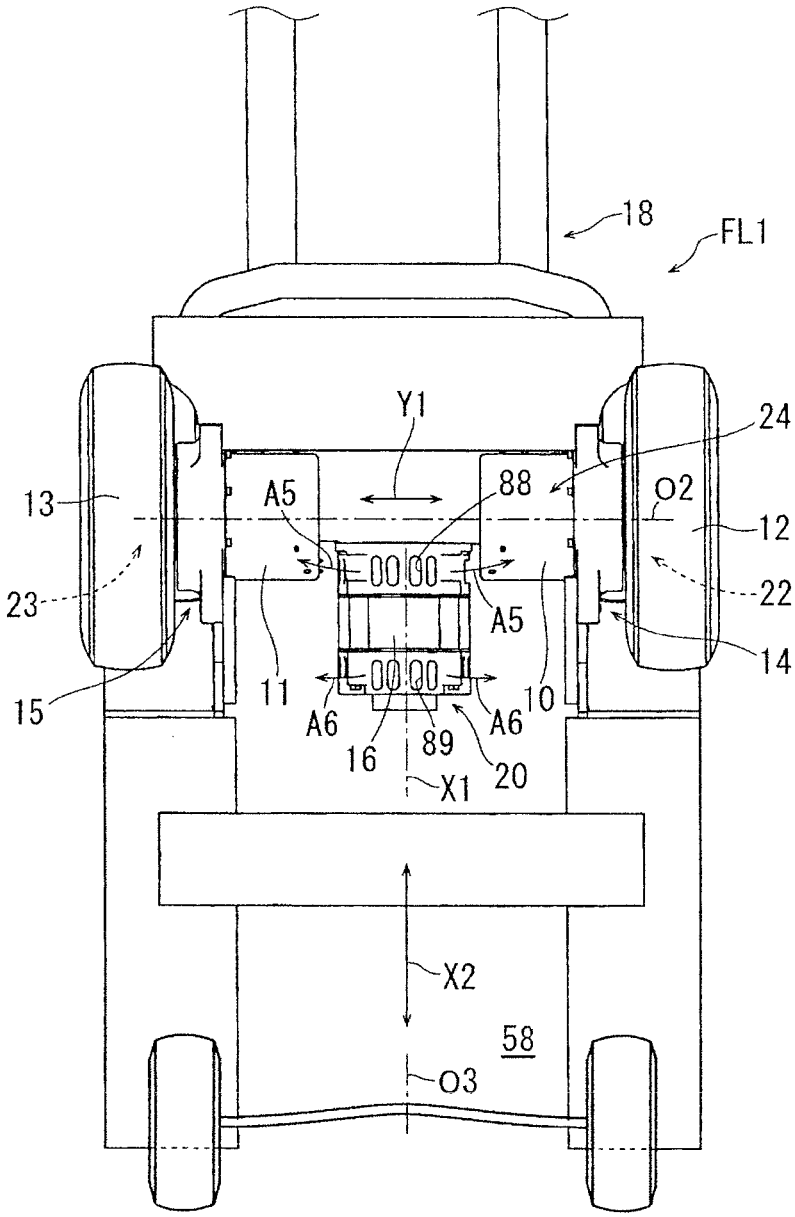
FIG. 1 is a schematic bottom plan view when a forklift related to an example of an embodiment of the invention is seen from the underside of a vehicle body.
Figure 2:
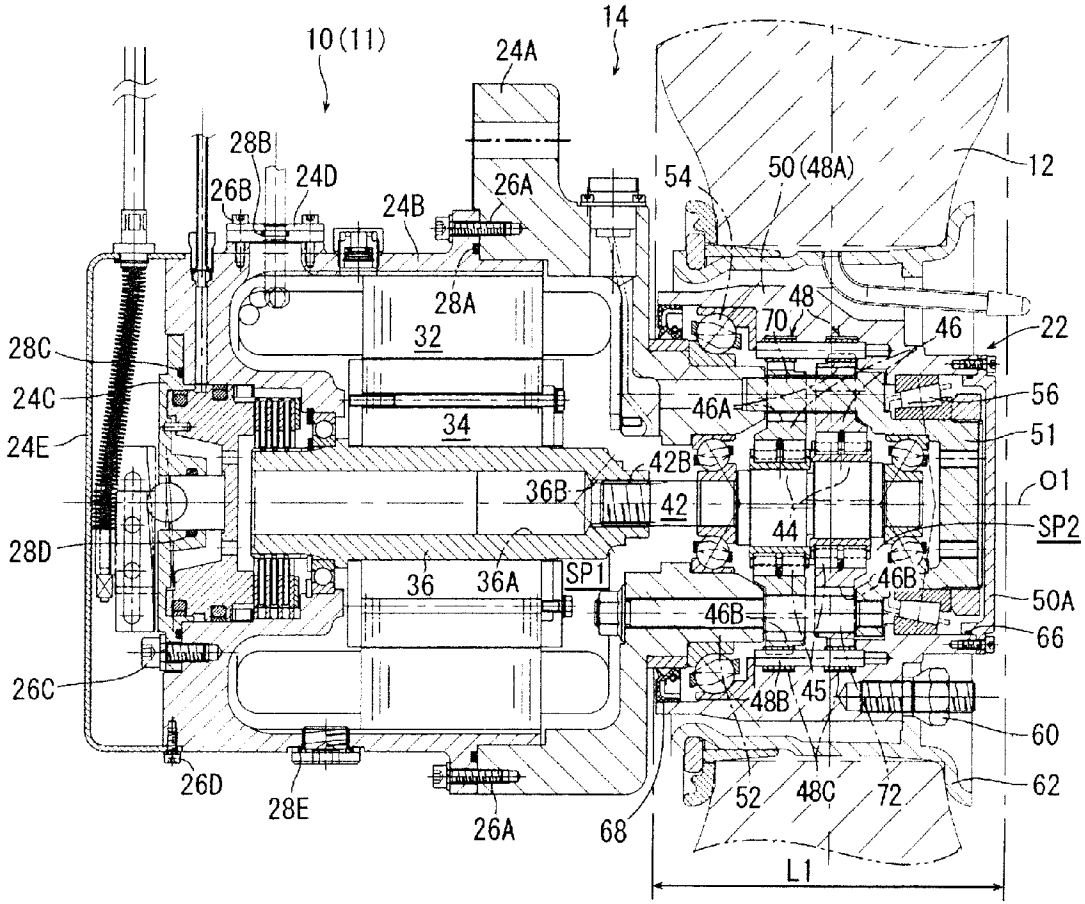
FIG. 2 is a cross-sectional view showing chief parts of a wheel driving device of the above forklift.

FIG. 1 is a schematic bottom plan view when a forklift related to an example of an embodiment of the invention is seen from the underside of a vehicle body, and FIG. 2 is a cross-sectional view showing chief parts of a wheel driving device of the forklift.

The forklift FL1 includes wheel driving devices 14 and 15 that have traveling motors 10 and 11 and drive wheels 12 and 13, respectively, and a cargo handling device 20 that has a cargo handling motor 16 and drives a cargo handling mechanism 18, such as a fork.

The wheel driving devices 14 and 15 have the same configuration, and are individually provided for left and right wheels 12 and 13, respectively. The details on the wheel driving device 14 side are shown in FIG. 2.

The wheel driving device 14 has the traveling motor 10 driven by a battery that is not shown, and a speed reducer 22 coupled to the traveling motor 10. As for the traveling motor 10, a casing 24 is constituted by a plurality of (three in this example) casing bodies 24A to 24C and cover bodies 24D and 24E. The respective casing bodies 24A to 24C and the respective cover bodies 24D and 24E are sealed by a plurality of bolts 26A to 26D and seal members 28A to 28E to form a motor inner space (first space) SP1. Lubricating oil is enclosed in the motor inner space SP1. That is, the traveling motor 10 is a liquid cooling motor (oil-bath motor) that is cooled by lubricating oil.

In addition, reference numeral 32 in the drawing designates a stator, reference numeral 34 designates a rotor, and reference numeral 36 designates a motor shaft (an output shaft of the traveling motor 10). The motor shaft 36 is constituted by a hollow shaft that has a hollow portion 36A in this example, and an end portion of the hollow portion 36A is formed with a (female) spline 36B for coupling with an input shaft 42 of the speed reducer 22.

In this example, the speed reducer 22 includes an eccentric oscillating type planetary gear speed-reducing mechanism, and all those constituent members are housed on the radial inner side within an axial range of the wheel 12 except for a portion of the input shaft 42 (an end portion on the motor side).

The speed reducer 22 includes the input shaft 42 having a (male) spline 42B that engages the (female) spline 36B of the motor shaft 36, an eccentric body 44 formed (integrally in this example) at the input shaft 42, an external gear 46 assembled into an outer periphery of the eccentric body 44 via rollers 45, and an internal gear 48 with which the external gear 46 internally meshes.

In this embodiment, the internal teeth of the internal gear 48 is constituted by an internal gear body 48A that is integrated with a speed-reducer casing 50, a supporting pin 48B that is rotatably supported by the internal gear body 48A, and outer rollers 48C that are rotatably assembled into an outer periphery of the supporting pin 48B and constitute the internal teeth of the internal gear 48. The internal teeth (the number of the outer rollers 48C) of the internal gear 48 are slightly (one in this example) more than the number of the external teeth of the external gear 46.

A pair of first and second carriers 51 and 52 are assembled on both axial sides of the external gear 46 so as to be rotatable relative to the speed-reducer casing 50 via an angular ball bearing 54 and a tapered roller bearing 56. In this example, the first and second carriers 51 and 52 are in a fixed state where the carries are integrated with the casing body 24A coupled to the vehicle body (or a member integrated with the vehicle body) 58, and the speed-reducer casing 50 rotates relative to the first and second carriers 51 and 52. That is, the speed reducer 22 is a so-called internal teeth rotation (casing rotation) type speed reducer that has the speed-reducer casing 50 as an output member. The wheel 12 is integrated with the speed-reducer casing 50 via bolts 60 and a tire frame 62.

The speed-reducer casing 50 forms a speed-reducer inner space (second space) SP2 sealed via the seal members 66 and 68 together with the second carrier 52 and a cover body 50A. The speed-reducer inner space SP2 communicates with the aforementioned motor inner space SP1. That is, the motor inner space (first space) SP1 and the speed-reducer inner space (second space) SP2 communicate with each other, and common lubricating oil is able to circulate through both the spaces of the motor inner space SP1 and the speed-reducer inner space SP2.

An inner pin hole 46A and a carrier pin hole 46B are formed at positions offset from an axial center O1 of the input shaft 42 in the external gear 46. Inner pins 70 integrated with the first carrier 51 are loosely fitted into the inner pin hole 46A in a state where some pins thereof come into contact with the external gear 46. Carrier bolts 72 that connect the first and second carriers 51 and 52 are loosely fitted into the carrier pin hole 46B in non-contact with the external gear 46.

By virtue of this configuration, the relative rotation of the internal gear 48 (speed-reducer casing 50) to the external gear 46 whose rotation on its own axis is restrained by the inner pins 70 can be taken out as the rotation of the wheel 12 fixed to the speed-reducer casing 50.

On the other hand, the cargo handling motor 16 of the cargo handling device 20 that drives the cargo handling mechanism 18 of the forklift FL1, as shown in FIG. 1, is arranged between the left and right wheel driving devices 14 and 15 in a left-and-right direction Y1 of the forklift FL1. More specifically, the cargo handling motor 16 is arranged at a position slightly further toward the rear of the vehicle body than an axial center O2 (axle: the same as the axial center O1 of the input shaft 42) of the left and right wheel driving devices 14 and 15 between (center O3) the left and right wheel driving devices 14 and 15 such that an axial direction X1 of the cargo handling motor 16 is turned to a front-and-rear direction X2 of the forklift FL1.

Figure 3:
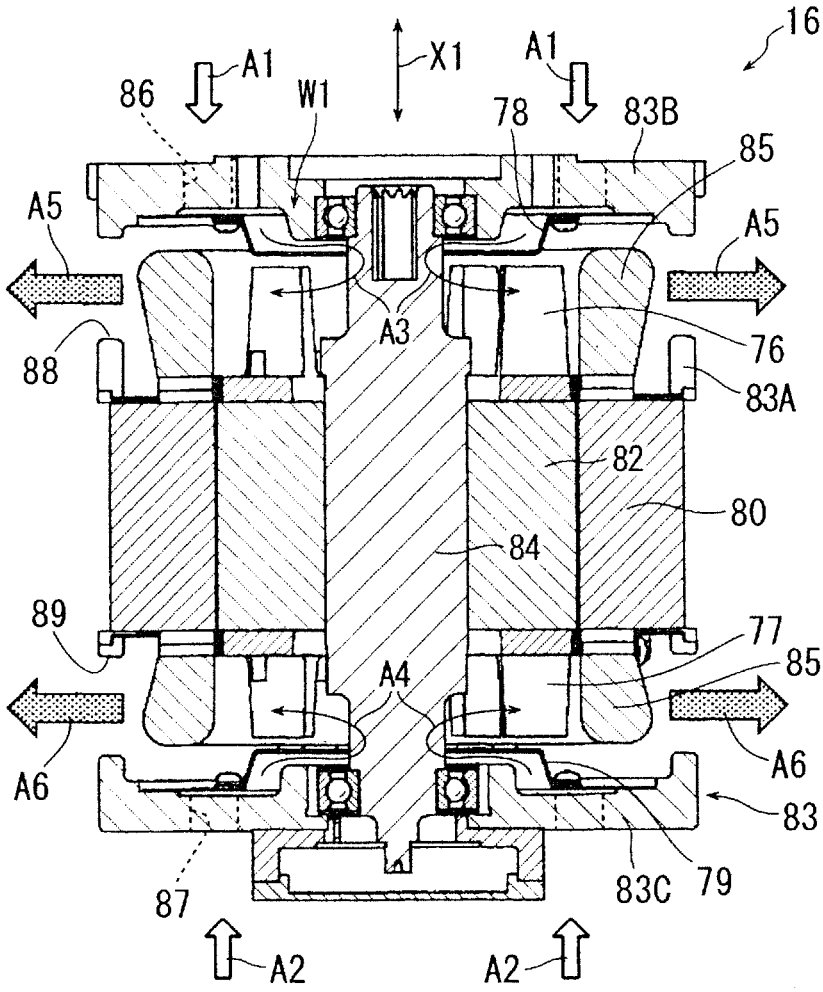
FIG. 3 is a cross-sectional view showing the configuration of a cargo handling motor of the above forklift.
Figure 4:
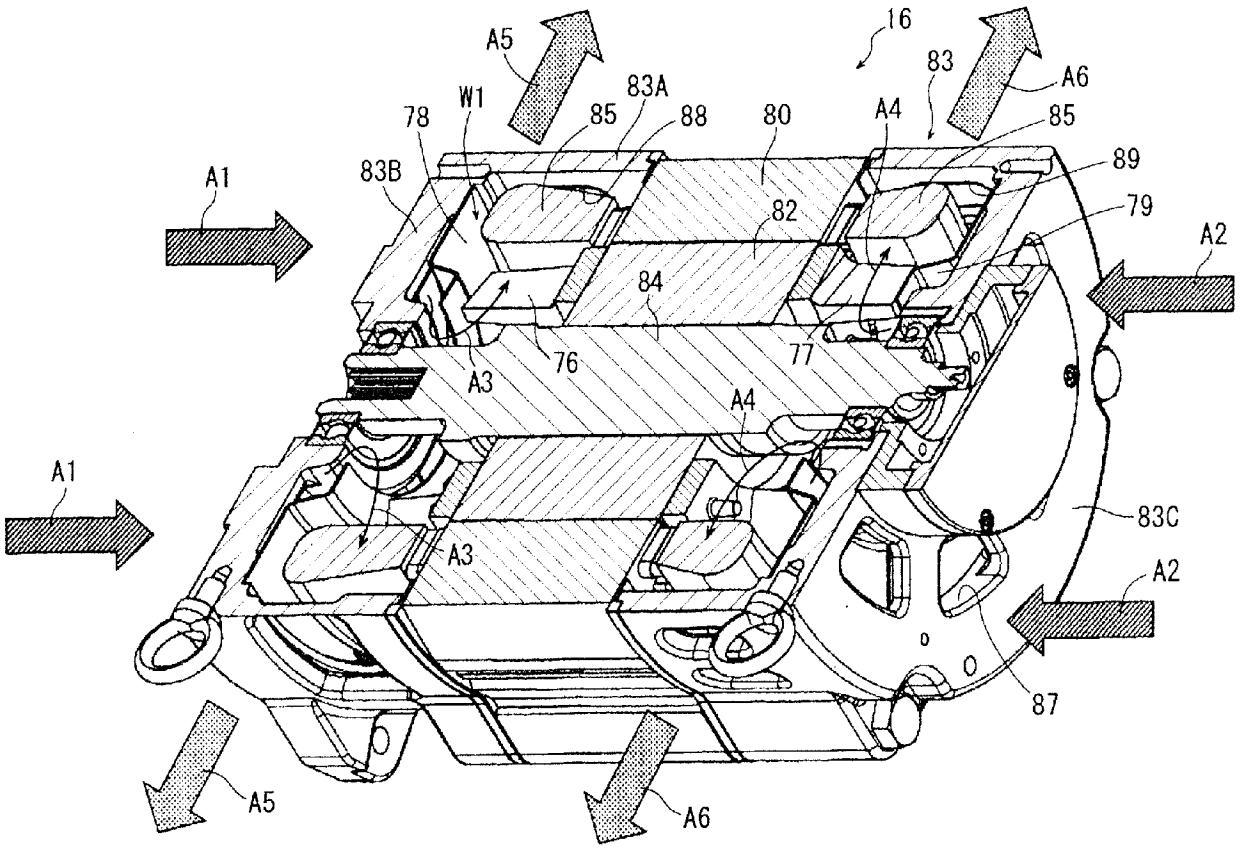
FIG. 4 is a perspective view of the cargo handling motor cut in the cross-section of FIG. 3.

As shown in FIGS. 3 and 4, the cargo handling motor 16 includes a rotor 82 on the inner side of the stator 80, and an output shaft 84 integrated with the rotor 82 by press-fitting. Reference numeral 85 designates coils (ends).

A casing 83 of the cargo handling motor 16 has a cylindrical casing body 83A parallel to the axial direction X1 of the cargo handling motor 16, and side covers 83B and 83C that constitute end faces in the axial direction. In this embodiment, eight suction ports 86 and 87 are formed in a circumferential direction at equal intervals in side covers 83B and 83C, respectively. In addition, although the outer peripheral surface of the stator 80 of the cargo handling motor 16 of the present embodiment is exposed to the outside (is not configured to be covered with the casing), the invention is not limited to such a configuration, and a casing may also be arranged on the outside of the stator 80.

Additionally, a plurality of discharge ports 88 and 89 are formed at positions corresponding to both axial sides of the stator 80 of the casing body 83A. Rotor fins 76 and 77 are provided at the both axial ends of the rotor 82. The rotor fins 76 and 77 constitute a wind generating mechanism W1 that generates wind together with straightening vanes 78 and 79 by the rotation of the output shaft 84 (rotor 82) of the cargo handling motor 16. That is, the cargo handling motor 16 is an air-cooling motor having the wind generating mechanism W1 (the rotor fins 76 and 77 and the straightening vanes 78 and 79) that generates wind by the rotation of the output shaft 84.

More specifically, since the cargo handling motor 16 rotates normally and reversely, even when the motor rotates in any direction, the formation angle (shape) of the rotor fins 76 and 77 and the shape of the straightening vanes 78 and 79 are set so that a wind flow in the same direction is generated. The straightening vanes 78 and 79 are bent on the radial inner side so as to be closer the rotor fin 76, and are assembled in such a shape that a negative pressure is relatively easily formed further toward on the discharge ports 88 and 89 side (radial outer side) than the bent portion. In other words, in this embodiment, the formation angle (shape) of the rotor fins 76 and 77 and the shape of the straightening vanes 78 and 79 are set so that wind suctioned in the axial direction from the suction ports 86 and 87 (arrows A1 and A2) runs around to (arrows A3 and A4) to the axial inner side of the straightening vanes 78 and 79 at a radial central portion of the cargo handling motor 16, flow to the radial outer side while heat-exchanging with, the rotor 82, the coils 85, and the like, and are discharged from the discharge ports 88 and 89 to the radial outer side (arrows A5 and A6).

Referring back to FIG. 1, this embodiment is configured so that the wind indicated by arrow A5 among the wind (arrows A5 and A6) discharged from the discharge ports 88 and 89 of the cargo handling motor 16 reaches the wheel driving devices 14 and 15. More specifically, in the forklift FL1 related to this embodiment, the cargo handling motor 16 is arranged such that its own axial direction X1 is turned toward the front-and-rear direction X2 of the vehicle body 58, slightly behind the axle O2 on the center O3 of the forklift FL1 in the left-and-right direction Y1. The wind (arrow A5) discharged from the front discharge port 88 of the cargo handling motor 16 is discharged in the left-and-right direction Y1 of the vehicle body 58 toward the left and right wheel driving devices 14 and 15, and reaches the wheel driving devices 14 and 15.

Next, the operation of the forklift FL1 will be described.

If the motor shaft 36 of the traveling motor 10 rotates, the input shaft 42 of the speed reducer 22 coupled to the motor shaft 36 via the splines 36B and 42B rotates, and the eccentric body 44 integrated with the input shaft 42 rotates. If the eccentric body 44 rotates, the external gear 46 internally meshes with the internal gear 48 while oscillating via the rollers 45.

The rotation of the external gear 46 on its own axis is restrained by the pair of first and second carriers 51 and 52 via the inner pins 70. For this reason, the external gear 46 performs only oscillation without rotating on its own axis. As a result, a phenomenon in which the meshing position between the external gear 46 and the internal gear 48 shifts sequentially occurs, and the internal gear 48 (speed-reducer casing 50) rotates by an amount equivalent to the number-of-teeth difference between the external gear 46 and the internal gear 48 whenever the input shaft 42 (eccentric body 44) makes one rotation. As a result, the speed reduction rotation of 1/(N+1) is realized. The rotation of the speed-reducer casing 50 is transmitted to the tire frame 62 via the bolts 60, and the wheel 12 (and 13) integral with the tire frame 62 is driven.

On the other hand, the cargo handling motor 16 is driven independently from the traveling motor 10 during a cargo handling operation. If the output shaft 84 (rotor 82) of the cargo handling motor 16 rotates, the air outside the cargo handling motor 16 is suctioned into the cargo handling motor 16 along the axial direction from the suction port 86 formed in an axial end portion of the cargo handling motor 16 (arrow A1 and A2), runs around from the radial central portion of the straightening vanes 78 and 79, and cools the coils 85 or the like of the cargo handling motor 16 (arrows A3 and A4). In this embodiment, particularly, the wind discharged from the discharge port 88 located on the front side of the vehicle body 58 flows along the left-and-right direction Y1 of the vehicle body 58 toward the radial outer side of the cargo handling motor 16, and reaches the wheel driving devices 14 and 15 (arrow A5).

Here, in order to make the actions of the present embodiment more easily understood, the cooling structure of the present embodiment will be described in detail while being compared with a related-art cooling structure.

The related art is based on a technical idea described in Paragraph [0003] of the related art as follows: "although a cooling fan also always operates to always cool a traveling motor 11 in the traveling motor that is always operating, since a motor for a operating machine stops when an operation in the operating machine is not performed in the motor for an operating machine, the cooling fan also comes to stop, and thereby, the motor for an operating machine cannot always be cooled, and the motor for an operating machine heats and fails".

However, since the cargo handling motor stops when only traveling is performed without performing a cargo handling operation in the forklift, the problem of overheating of the cargo handling motor does not easily occur initially. Additionally, since the cargo handling motor 16 itself can generate wind in a case where a cargo handling operation is performed in parallel during traveling, the problem of overheating of the cargo handling motor does not easily occur even in this case.

On the other hand, a problem in the related-art structure is that it is not possible to cope with a state where "traveling often becomes a low speed during a cargo handling operation, wind itself generated by the traveling motor decreases, and a wheel driving device itself overheats somewhat". As long as traveling is made even during low-speed traveling, both the traveling motor 11 and the speed reducer 22 heats up. Moreover, the cargo handling operation is a main operation of the forklift FL1, and often lasts for a prolonged time by its nature.

The present embodiment is configured so that attention is paid to the fact that the cargo handling motor 16 is actively moved during a cargo handling operation in which the wheel driving device 14 (15) becomes severe in terms of overheating, and the wind generated by the cargo handling motor 16 reaches the wheel driving device 14 (15). Although this flow is exactly opposite to the flow of cooling wind in the related art, during a cargo handling operation in which the rotation of the traveling motor 10 (11) tends to become slow due to this, the wheel driving device 14 (15) can be efficiently cooled.

In the above embodiment, the effective actions as follows are additionally obtained.

As is clear from FIG. 2, in the forklift FL1 related to this embodiment, all the constituent elements of the speed reducer 22 of the wheel driving device 14 except for a portion of the input shaft 42 are housed on the radial inner side within the axial range L1 of the wheel 12. That is, a configuration is provided in which the fact itself that wind is applied to the speed reducer 22 is very difficult. As a result, a situation is incurred in which, particularly, the speed reducer 22 in the wheel driving device 14 easily overheats somewhat. If the speed reducer 22 overheats somewhat, the temperature of the lubricating oil within the speed reducer 22 rises, the viscosity of the lubricating oil decreases, and formation of an oil film on power transmission members within the speed reducer 22 becomes difficult (when the rotational speed of the wheel driving device 14 is low like during a cargo handling operation, the formation of the oil film becomes particularly difficult). This causes a decrease in lifespan and a decline in transmission efficiency.

In order to overcome this problem, in the above embodiment, hybrid cooling of the "liquid cooling+forced air cooling" by the synergic action with the cargo handling motor 16 is performed.

That is, in the above embodiment, first (a) the traveling motor 10 itself is not probably air-cooled by a cooling fan (in which wind does not reach easily) but is liquid-cooled using lubricating oil. In addition, (b) the motor inner space SP1 of the traveling motor 10 and the speed-reducer inner space SP2 of the speed reducer 22 are made to communicate with each other, and lubricating oil is enabled to circulate through the two spaces SP1 and SP2. On the other hand, (c) the cargo handling motor 16 is air-cooled by the rotor fins 76 and 77, and (d) wind that is generated and discharged in the cargo handling motor 16 is applied to, particularly, the portion of the traveling motor 10 in the wheel driving device 14.

Thereby, in the wheel driving device 14, wind blown off from the discharge port 88 of the cargo handling motor 16 can be intensively applied to the traveling motor 10 (to which wind is easily applied) exposed from the wheel 12, and the lubricating oil of the traveling motor 10 can be effectively cooled. Thus, since the cooled lubricating oil is in the same bath as the lubricating oil of the speed reducer 22, eventually, the whole wheel driving device 14 including the traveling motor 10 and the speed reducer 22 can be more reliably and favorably cooled.

Various variations are considered in the invention.

Figure 5:
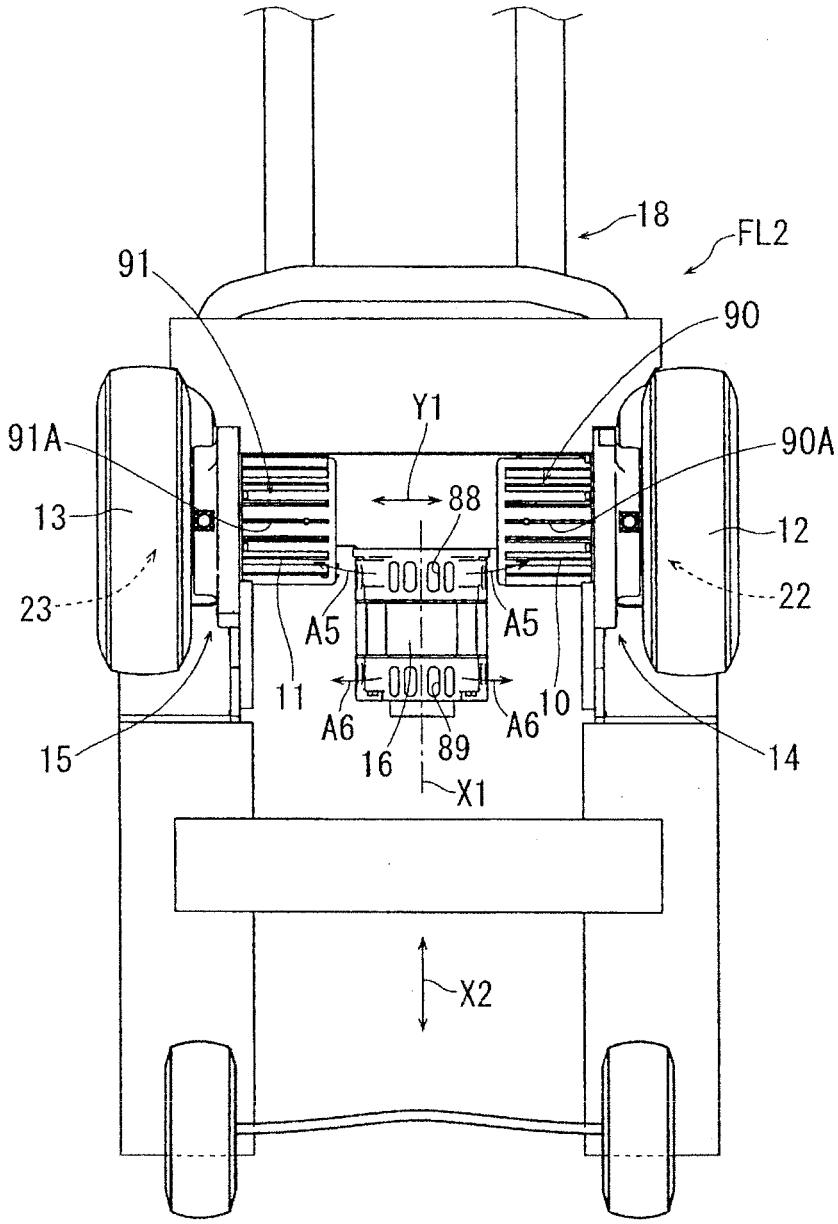
FIG. 5 is a schematic bottom plan view equivalent to FIG. 1, of a forklift related to an example of another embodiment of the invention.

An example of another embodiment of the invention is shown in FIG. 5. In addition, in the subsequent description of variations, members using the same reference numerals mean being conceptually the same as the members that are basically already described.

A forklift FL2 related to this embodiment is different from the previous embodiment in that casings 90 and 91 of the traveling motors 10 and 11 of the wheel driving devices 14 and 15 have fins 90A and 91A that extend in the axial direction. In the previous embodiment, as already described, the cargo handling motor 16 is arranged between the left and right wheel driving devices 14 and 15 in the left-and-right direction Y1 of the forklift FL2 such that the axial direction X1 of the cargo handling motor 16 is turned to the front-and-rear direction X2 of the forklift FL2. Additionally, the cargo handling motor 16 is provided with the discharge ports 88 and 89 so that the wind generated by the wind generating mechanism W1 is discharged in the radial direction (arrows A5 and A6).

Accordingly, the wind (arrow A5) discharged from the discharge port 88 of the cargo handling motor 16 is applied to the traveling motors 10 and 11 as wind that flows generally in the left-and-right direction Y1. Therefore, if the casings 90 and 91 of the traveling motors 10 and 11 have fins 90A and 91A that extend along the axial direction as in this embodiment, contact area can be increased without becoming resistance against wind that flows in the left-and-right direction Y1, and the cooling efficiency of the whole wheel driving devices 14 and 15 including the traveling motors 10 and 11 and further the speed reducers 22 and 23 can be further enhanced.

Figure 6:
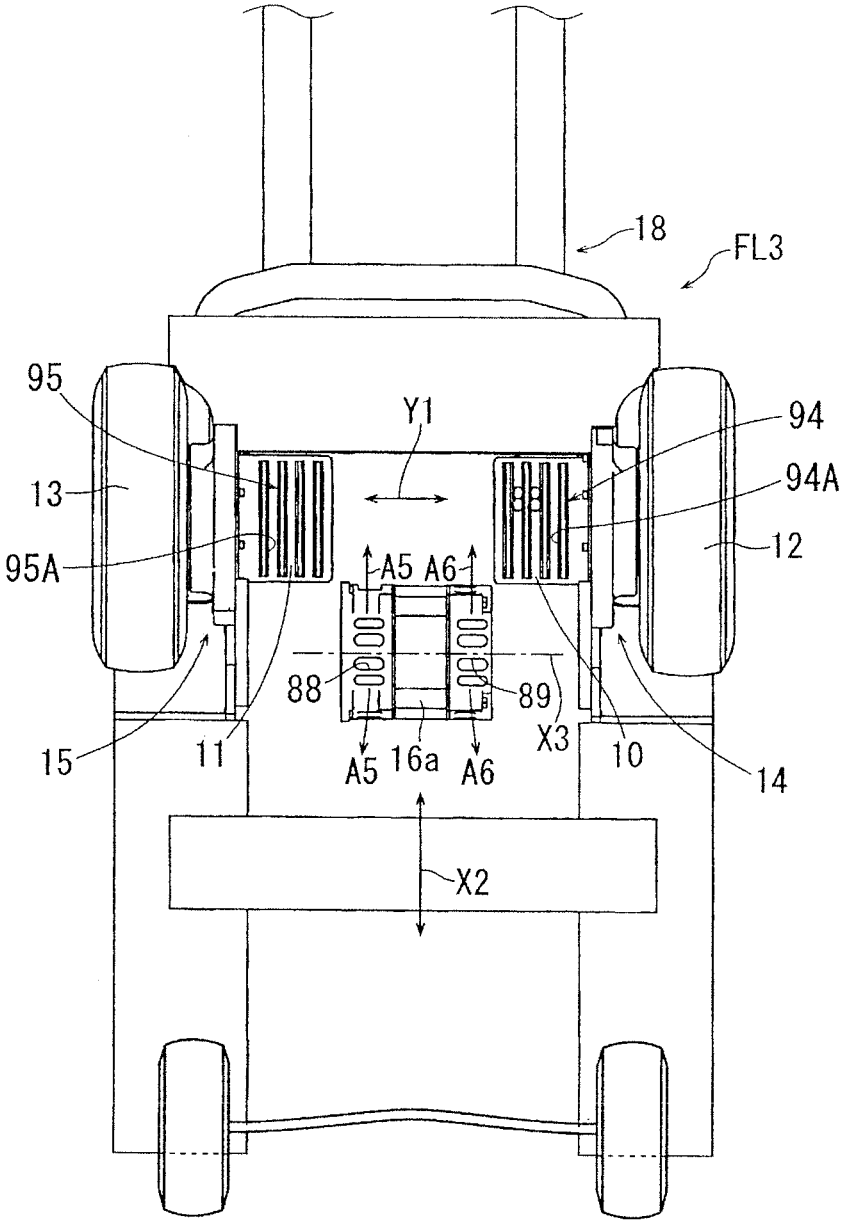
FIG. 6 is a schematic bottom plan view equivalent to FIG. 1, of a forklift related to an example of still another embodiment of the invention.

An example of still another embodiment of the invention is shown in FIG. 6.

In a forklift FL3 related to this embodiment, the cargo handling motor 16*a* is arranged such that an axial direction X3 of the cargo handling motor 16*a* is turned to the left-and-right direction Y1 of the forklift FL3. Additionally, the cargo handling motor 16*a* itself has the same configuration as the cargo handling motor 16 of the previous embodiment. In this case, wind (cooling wind) discharged from the cargo handling motor 16*a* is applied to the traveling motors 10 and 11 as wind that flows generally in the circumferential direction (front-and-rear direction X2). Therefore, in casings 94 and 95 of the traveling motors 10 and 11, if fins 94A and 95A that extend in the circumferential direction are formed (rather than forming the fins 90A and 91A that extend in the axial direction as in the embodiment of FIG. 5), contact area can be increased without becoming resistance against wind that flows in the front-and-rear direction X2.

In this embodiment, in this regard, since the traveling motors 10 and 11 have the fins 94A and 95A that extend in the circumferential direction, the cooling efficiency of the whole wheel driving device 14 and 15 including the traveling motors 10 and 11 and further the speed reducers 22 and 23 can be further enhanced.

Figure 7:
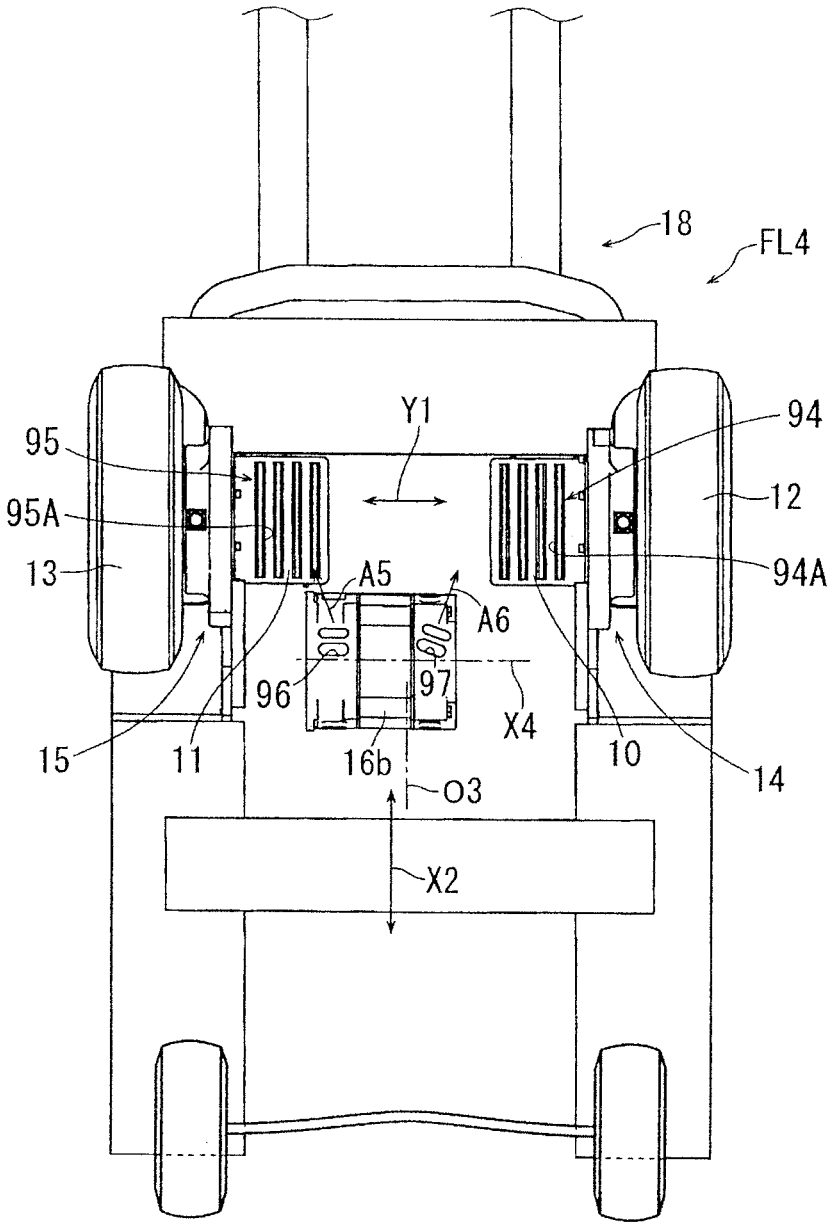
FIG. 7 is a schematic bottom plan view equivalent to FIG. 1, of a forklift related to an example of a still further embodiment of the invention.

An example of a still further embodiment of the invention is shown in FIG. 7.

Even in the forklift FL4 related to this embodiment, a cargo handling motor 16*b* is arranged such that an axial direction X4 of the cargo handling motor 16*b* is turned to the left-and-right direction Y1 of forklift FL4. However, unlike the previous embodiment of FIG. 6, the distances to the left and right wheel driving devices 14 and 15 from the cargo handling motor 16*b* are different. That is, the cargo handling motor 16*b* is arranged at a position shifted from the center O3 of the vehicle body 58 in the left-and-right direction Y1.

Figure 8:
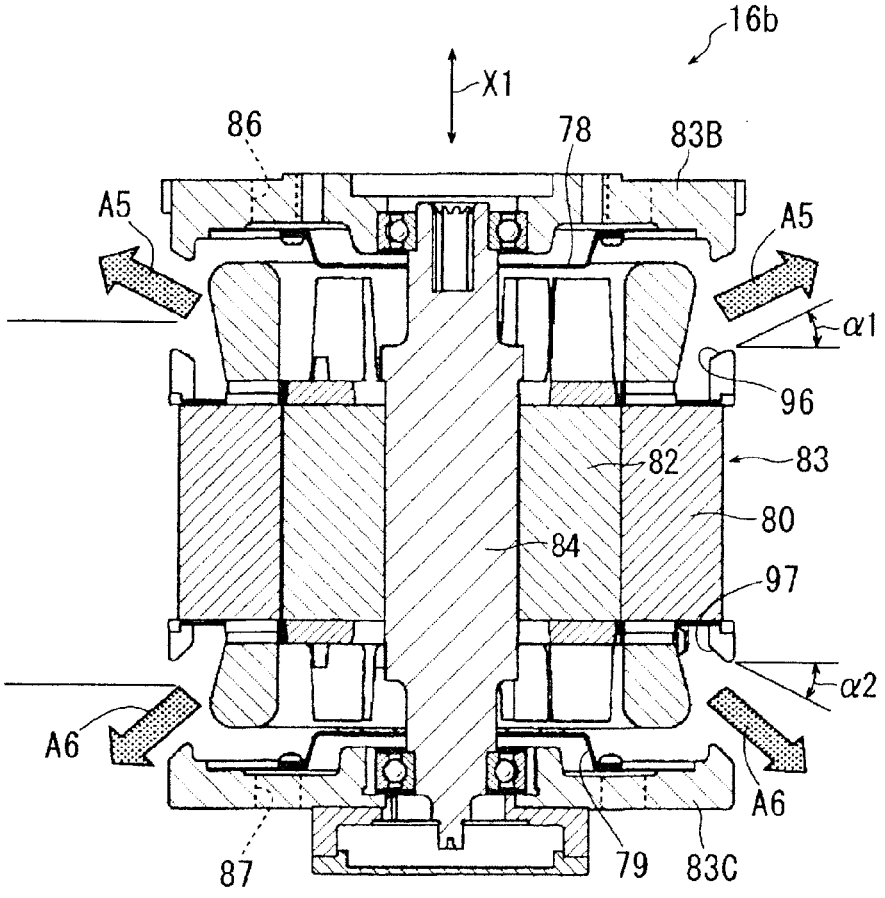
FIG. 8 is a cross-sectional view equivalent to FIG. 3, of a cargo handling motor related to the example of FIG. 7.

Thus, in the cargo handling motor 16*b* related to this embodiment, as shown in FIG. 8, respective discharge ports 96 and 97 have their own discharge angles $\alpha 1$ and $\alpha 2$ ($\alpha 1 < \alpha 2$) other than the radial direction in order to discharge wind toward the wheel driving devices 14 and 15, respectively. The discharge angles $\alpha 1$ and $\alpha 2$ can be realized, for example, by changing the arrangement angle or bent shape of the straightening vanes 78 and 79 of the cargo handling motor 16*b*, and the formation angle of the cross-sections of the discharge ports 96 and 97 in a casing 83. As a result, wind discharged from the cargo handling motor 16 can be made to reach the respective wheel driving devices 14 and 15 without causing waste as much as possible.

In this way, in the present invention, the specific arrangement position or the arrangement direction of the wheel driving device or the cargo handling motor with respect to the vehicle body are not particularly limited. The fins formed on the traveling motor may also be formed in arbitrary ways and in arbitrary directions (in consideration of the flow of cooling wind) including the presence/absence of formation.

Additionally, in all the above embodiments, an example is shown in which the wheel driving devices are individually at the left and right wheels, respectively. Since some or many portions of the wheel driving device (speed reducer) are arranged on the radial inner side of the wheel, this configuration, as also shown in the above example, is a structure in which excellent cooling is particularly difficult and the effects of the invention appear most remarkably. However, the forklift related to the invention is not necessarily limited to a configuration in which the wheel driving devices are provided individually at the left and right wheels, respectively, in this way, and may be, for example, a forklift of a configuration of in which the power of one wheel driving device is divided and transmitted to two wheels. Even in this case, the cooling of the wheel driving device during a cargo handling operation can be similarly promoted by applying wind discharged from the cargo handling motor to the wheel driving device.

Additionally, in the above embodiment, the wheel driving device itself has a structure in which the traveling motor and the speed reducer adopt a liquid cooling type cooling structure, and the motor inner space (first space) within the traveling motor and the speed-reducer inner space (second space) of the speed reducer are made to communicate with each other, and lubricating oil are capable of circulating through both the spaces. However, in the present invention, the wheel driving device does not necessarily have such a cooling structure. For example, the first space within the traveling motor and the second space within the speed reducer may be independent spaces. Moreover, the traveling motor may be not liquid-cooled but air-cooled. The speed reducer may also be air-cooled (not liquid-cooled), for example, so long as grease can be used. Even in any case, the effect of the cooling structure that the wheel driving device itself has uniquely can be further enhanced by applying wind discharged from the cargo handling motor to the wheel driving device during a cargo handling operation.

Moreover, in the above embodiments, the wind generating mechanism that generates wind by the rotation of the motor shaft of the cargo handling motor is constituted by the rotor fins and straightening vanes that are attached to the rotor in the cargo handling motor. However, in the present invention, whether the wind generating mechanism of the cargo handling motor adopts any kind of configuration is also not particularly limited. That is, for example, when there is a margin in terms of space, a configuration may be adopted in which an exclusive "cooling fan" and an exclusive "fan cover" are attached to the motor shaft made to protrude out of the casing (side cover) of the cargo handling motor. In this case, the cooling fan and its fan cover are equivalent to the "wind generating mechanism that generates a wind by the rotation of the motor shaft of the cargo handling motor" in the present invention, or an air outflow hole of the fan cover, or an opening formed between an outer periphery of the casing of the cargo handling motor and an inner periphery of the fan cover is equivalent to the "discharge port that discharges a wind generated by the wind generating mechanism" in the present invention.

Additionally, in the above embodiments, wind discharged from the discharge port of the cargo handling motor is directly released toward the wheel driving device side. However, in the present invention, a duct directed from the discharge port to the wheel driving device, a duct that reaches the wheel driving device, or the like may be appropriately formed so that the wind discharged from the discharge port of the cargo handling motor more reliably reaches the wheel driving device. Even if not closed like the duct, a guide plate that appropriately changes the flow direction of wind may be attached. Thereby, the wind discharged from the cargo handling motor can be applied in a concentrated manner to a most effective portion of the wheel driving device without waste. Additionally, for example, wind that comes out from the discharge port located opposite to the wheel driving device side of the cargo handling motor (as far as the above example is concerned, for example, the wind discharged from the discharge port 89) can also be positively guided to the wheel driving device side by the duct or the guide plate, whereby the wind discharged from the cargo handling motor can be utilized without waste, and higher-efficiency cooling can be performed.

Additionally, in the above embodiments, the cargo handling motor is arranged such that the axial direction thereof is turned to the front-and-rear direction or the left-and-right direction of the forklift. In the present invention, the arrangement direction of the cargo handling motor is not limited to this, and the cargo handling motor may be arranged in arbitrary directions (angles) at arbitrary positions so long as the wind generated by the wind generating mechanism of the cargo handling motor reaches the wheel driving device.

It should be understood that the invention is not limited to the above-described embodiment, but may be modified into various forms on the basis of the spirit of the invention. Additionally, the modifications are included in the scope of the invention.

What is claimed is:

1. A forklift comprising:

a wheel driving device that includes a traveling motor and drives a wheel; and a cargo handling device that includes a cargo handling motor and drives a cargo handling mechanism, wherein the cargo handling motor includes:

a wind generating mechanism that generates wind by the rotation of a motor shaft of the cargo handling motor; and a discharge port that discharges the wind generated by the wind generating mechanism, and wherein the cargo handling motor is arranged in a vehicle body of the forklift so that wind discharged from the discharge port reaches the wheel driving device.

2. The forklift according to claim 1, wherein wheel driving devices are individually provided at left and right wheels, respectively.

3. The forklift according to claim 2, wherein the wheel driving device includes a speed reducer that is coupled to the traveling motor, and wherein a first space within the traveling motor and a second space in the speed reducer communicate with each other, and lubricating oil is enabled to circulate through both the first and second spaces.

4. The forklift according to claim 2, wherein the cargo handling motor is arranged between the left and right wheel driving devices in a left-and-right direction of the forklift such that an axial direction of the cargo handling motor is turned to a front-and-rear direction of the forklift, wherein the discharge port is provided so that wind generated by the wind generating mechanism is discharged in a radial direction, and wherein the traveling motor of the wheel driving device includes fins that extend along the axial direction.

5. The forklift according to claim 2, wherein the cargo handling motor is arranged such that an axial direction of the cargo handling motor is turned to a left-and-right direction of the forklift, wherein the discharge port is provided so that wind generated by the wind generating mechanism is discharged in a radial direction, and wherein the traveling motor of the wheel driving device includes fins that extend along in a circumferential direction.

6. The forklift according to claim 2, wherein the cargo handling motor includes discharge ports that are arranged at positions where the distances to the left and right wheel driving devices are different and that discharge wind toward the wheel driving devices, respectively.

* * * * *